US006196126B1

(12) United States Patent
Smith et al.

(10) Patent No.: US 6,196,126 B1
(45) Date of Patent: Mar. 6, 2001

(54) METHOD AND APPARATUS FOR PREVENTING PIGMENT BUILDUP DURING A ROTARY SCREEN PRINTING PROCESS

(75) Inventors: Garnett H. Smith, Gastonia; Jerry D. Hiatt, Mt. Airy; James E. Bruce, Greensboro, all of NC (US)

(73) Assignee: Intex Corporation, Greensboro, NC (US)

( * ) Notice: Subject to any disclaimer, the term of this patent is extended or adjusted under 35 U.S.C. 154(b) by 0 days.

(21) Appl. No.: 09/228,699

(22) Filed: Jan. 12, 1999

(51) Int. Cl.[7] ..... B41F 15/12
(52) U.S. Cl. ..... 101/114; 101/424
(58) Field of Search ..... 101/114, 116, 101/115, 120, 424, 423, 425; 15/256.5, 256.51

(56) References Cited

U.S. PATENT DOCUMENTS

| | | | | |
|---|---|---|---|---|
| 2,070,667 | * | 2/1937 | Lougee | 101/169 |
| 3,104,182 | * | 9/1963 | Schneider et al. | 15/256.51 |
| 4,077,317 | * | 3/1978 | Kiesewetter et al. | 101/167 |
| 4,299,164 | | 11/1981 | Jonkers | 101/120 |
| 4,384,521 | | 5/1983 | Muselaers | 101/116 |
| 4,436,032 | | 3/1984 | van Ouwerkerk | 101/120 |
| 4,557,194 | | 12/1985 | Zimmer | 101/120 |
| 4,627,345 | | 12/1986 | Watts | 101/119 |
| 4,628,857 | | 12/1986 | Coningsby | 118/406 |
| 5,007,523 | * | 4/1991 | Morfield | 15/256.5 |
| 5,297,490 | * | 3/1994 | Schneider et al. | 101/167 |
| 5,390,598 | | 2/1995 | Stauffer | 101/167 |
| 5,503,067 | * | 4/1996 | Jaffa | 101/120 |
| 5,515,782 | | 5/1996 | Ebina et al. | 101/424 |
| 5,564,338 | | 10/1996 | Branas | 101/424.1 |
| 5,575,211 | | 11/1996 | Harrison | 101/425 |
| 5,636,570 | | 6/1997 | Ebina et al. | 101/424 |
| 5,692,444 | | 12/1997 | Claassen et al. | 101/424 |
| 5,730,057 | | 3/1998 | Loftus et al. | 101/425 |
| 5,732,631 | | 3/1998 | Walther et al. | 101/424 |
| 5,746,130 | | 5/1998 | Andl et al. | 101/424 |
| 5,753,048 | | 5/1998 | Lippold et al. | 134/18 |
| 5,762,000 | | 6/1998 | Detmers | 101/124 |
| 5,775,218 | | 7/1998 | Zimmer | 101/120 |

FOREIGN PATENT DOCUMENTS

| | | | | |
|---|---|---|---|---|
| 2221291 | * | 2/1981 | (DE) | 101/167 |

OTHER PUBLICATIONS

Copy of website of Saxon Screens, Rotationsschalonen GMBH, URL http:/www.geocities.com/WallStreet/Exchange/4485; dated Nov. 13, 1998.

* cited by examiner

*Primary Examiner*—John S. Hilten
*Assistant Examiner*—Anthony H. Nguyen
(74) *Attorney, Agent, or Firm*—Rhodes & Mason, P.L.L.C.

(57) ABSTRACT

An apparatus and method for preventing excessive pigment buildup on the exterior surface of a rotary printing screen in a region adjacent the edge of fabric being printed including a flexible wiper member biased against the exterior surface of the rotary printing screen and positioned in the excessive pigment region and a mounting bracket for holding the wiper member in a predetermined orientation with respect to the exterior surface of the rotary printing screen. The wiper member is positioned in the excessive pigment region and is angled to the axis of rotation of the rotary printing screen so as to push the excessive pigment buildup away from the fabric being printed. The method further includes applying a lubricant stream to the exterior surface adjacent to and upstream of the flexible wiper member.

23 Claims, 8 Drawing Sheets

METHOD AND APPARATUS FOR PREVENTING PIGMENT BUILDUP DURING A ROTARY SCREEN PRINTING PROCESS

1. Field of the Invention

The present invention relates to rotary screen textile printing, and, more particularly to preventing the accumulation of printing pigment on undesired portions of the exterior surface of rotary printing screens.

2. Background of the Invention

Textile printing involves the application of color in the form of pigment to fabric in a design or pattern using a form of localized pigmenting. Modern textile printing processes include flat-bed screen printing, rotary screen printing, engraved roller printing and heat transfer printing. Rotary screen printing involves generally a technique for printing fabric that uses perforated metal screens shaped into the form of hollow cylinders. A fabric piece or web is fed past one or more screen arranged in succession with each of screens corresponding to the patterns for each color in a design. A color paste (or pigment) is fed into the interior of the cylinder along its longitudinal axis. A small metal roller or metal or rubber squeegee forces the paste from the interior of the cylinder through the holes and onto the fabric. The paste is squeezed through the cylinder in those areas where the holes in the screen are uncovered. Generally, the steps in this process include the preparation of a print paste, the printing of the fabric and fabric drying. Alternatively, the process may include fixation or curing of the pigment and a final washing off of the printed fabric. Through the use of laser engraving and CAD design techniques, very complex patterns may be created using rotary screen printing machines.

Rotary screen printing is widely used and offers numerous advantages over other types of textile printing. This process is faster than flat screen printing, having the capability to handle printing speeds up to 120 meters/minute. It permits the quick change over of patterns and also provides for continuous, repeating patterns. Moreover, changing colors is more economical than in roller printing processes such as intaglio printing.

In practice, because the width of the fabric being printed may vary slightly, the engraved pattern on the rotary screens is wider than the fabric to be sure the entire fabric is printed. It has been observed that, during the rotary screen printing process, pigment tends to accumulate or buildup on the exterior surface of the screens at a point just outside the fabric edge. This buildup may result in a so-called "dirty edge" on the printed fabric. This effect is not acceptable, particularly when printing knitted tubular fabric for body-sized garments.

Thus there is a need to prevent and/or remove excess pigment buildup on the rotary screens during printing. The present invention addresses these and other needs in the field.

SUMMARY OF THE INVENTION

The present invention addresses the problem that has been encountered during the printing of textile fabrics using a rotary screen printing process. The invention controls the described buildup of excessive printing pigment on the exterior surface of the rotary screens. The present invention utilizes a flexible wiper member which is biased against the exterior surface of the rotary printing screens in the marginal areas along either side to move the excess pigment away from the fabric being printed. The flexible wiper member prevents any appreciable amount of excess pigment to accumulate on the rotary screen exterior surface. A lubricating stream is provided upstream from and adjacent to the wiper member to maintain the pigment buildup in a pliable condition and to ensure that the flexible member does not attack the fragile rotary screen.

The present invention includes an apparatus for preventing excessive pigment buildup on at least one prescribed portion of the exterior surface of a rotary printing screen in a region adjacent the edge of the fabric being printed. The apparatus includes a flexible wiper member biased against the at least one portion of the exterior surface of the rotary printing screen and positioned in the excessive pigment region. The apparatus further includes a mounting bracket for holding the wiper member in a predetermined orientation with respect to the exterior surface of the rotary printing screen. A lubricant mist or stream may be applied to the outer surface of the rotary printing screen adjacent to and upstream of the flexible wiper member. The apparatus may further include a tensioning system attached to the mounting bracket for biasing the flexible wiper member against the exterior surface of the rotary printing screen.

In an alternative embodiment the present invention further relates to an apparatus for preventing excessive pigment buildup on at least one prescribed portion of on the exterior surface of a rotary printing screen in a region adjacent the edge of fabric being printed. The apparatus includes an preliminary flexible wiper member biased against the at least one portion of the exterior surface of the rotary printing screen and positioned in the excessive pigment region. The preliminary flexible wiper member is angled to the axis of rotation of the rotary printing screen so as to push a major portion of the excessive pigment buildup away from the fabric being printed. The apparatus further includes a primary flexible wiper member positioned downstream of the preliminary flexible wiper and biased against the exterior surface of the rotary printing screen. The primary flexible wiper is positioned in the excessive pigment region and is angled to the axis of rotation of the rotary printing screen so as to push a remaining portion of the excessive pigment buildup away from the fabric being printed. The apparatus may further include first and second lubricant streams applied to the rotary screen exterior surface adjacent to and upstream of the preliminary and primary flexible wiper members respectively.

The invention may further include a lubricant stream delivery system including at least one air supply line, a lubricant supply line, at least one lubricant metering valve in fluid communication with the lubricant supply line where the metering valve discharges to the air supply line to form at least one lubricant delivery line. The system further includes at least one rigid bendable conduit in fluid communication with the lubricant delivery line and a nozzle mounted on the rigid bendable conduit such that the nozzle is adapted to apply a lubricant stream to the exterior surface of the rotary printing screen.

The system may further include a plurality of lubricant metering valves connected to the lubricant supply line, each of the lubricant metering valves discharging to a plurality of air supply lines to form a plurality of lubricant lines. A plurality of rigid bendable conduits is in fluid communication with the plurality of lubricant lines, each of the conduits including a nozzle mounted thereon.

Thus it is an object of the present invention to improve the quality of printed textiles printed using a rotary screen process.

Still another object of the present invention is to create high quality printed goods using a rotary screen textile printing process with fabric that varies in width during the printing process.

A further object of the present invention is prevent the buildup of pigment/pigment on the exterior surface of a rotary printing screen during fabric printing process without causing damage to the rotary printing screens.

These and other objects and aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENT

Figure 1:
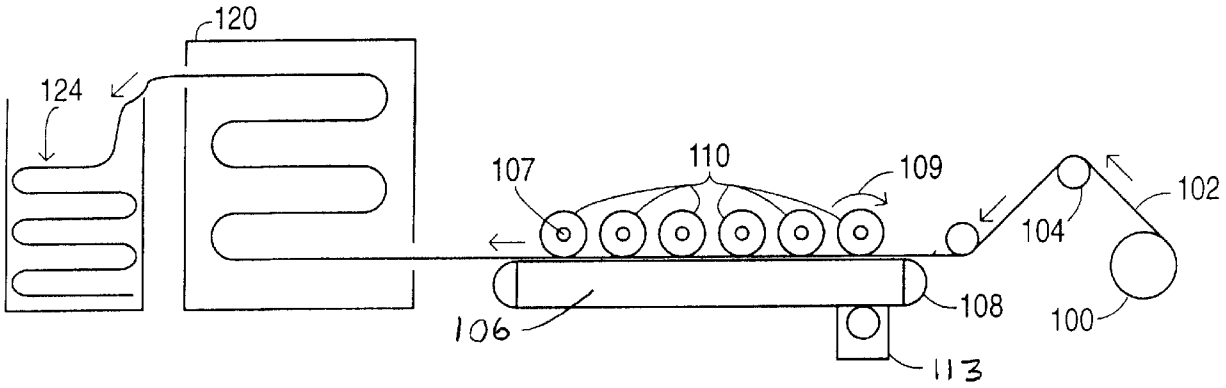
FIG. 1 is a schematic representation of a typical textile rotary screen printing process.
Figure 1A:
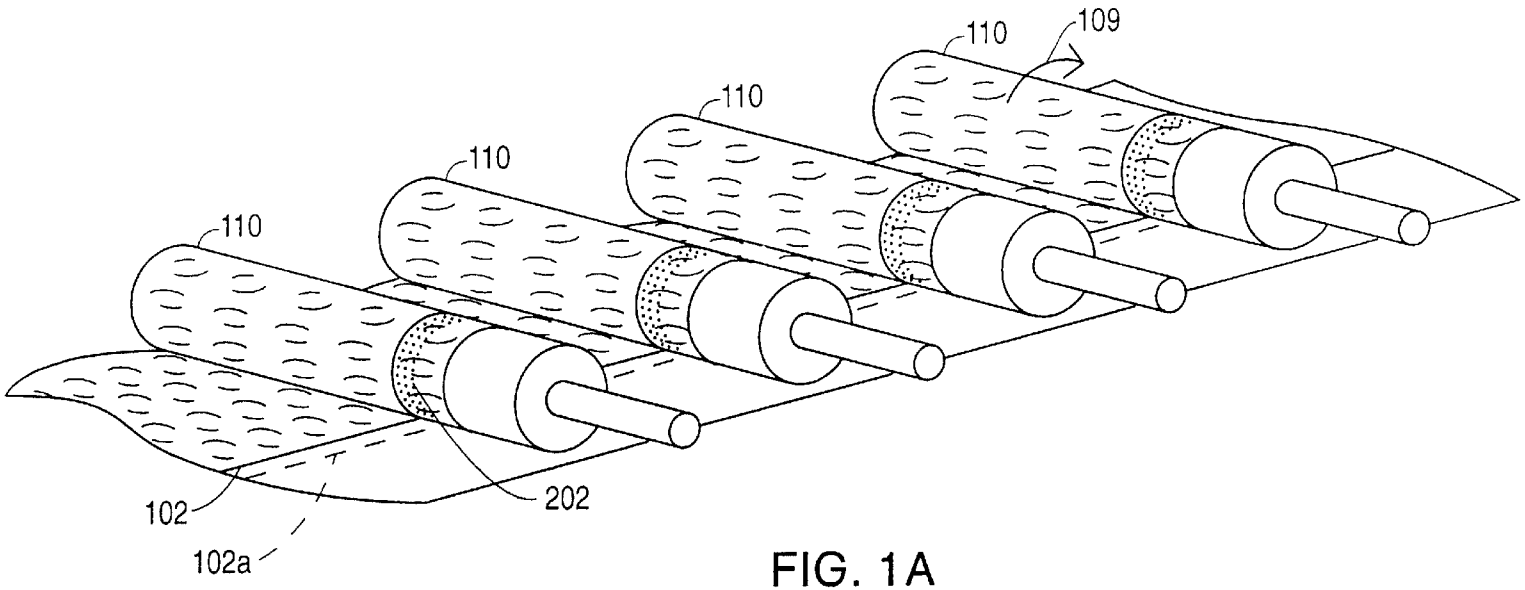
FIG. 1A is an isometric view of the printing screens used in a rotary screen printing process.

FIG. 1 is a schematic diagram of a typical rotary screen printing process. Delivery roll 100 supplies fabric 102 via scray roll 104 to printing bed 106. Printing bed 106 includes a flat bed about which rotates a belt 108. The fabric is held in place on the belt by a glue applied to the belt by glue box 113. A plurality of parallel printing screens 110 are arranged perpendicular to the direction of travel of the belt 108. The screens 110 rotate in the direction indicated by arrow 109 responsive to a drive system (not shown). Each screen 110 is positioned in a precisely determined registration with the other screens and applies one of a plurality of different colors of the design that will be printed onto the fabric 102. A complex design including many colors may require up to 12 screens. Each screen 110 is a perforated metal, hollow cylinder having a very small wall thickness. A color paste is fed through tubes 107 into the center of each screen 110. The paste is then distributed from the tube along the bottom of the screen along the width of the fabric. A small metal roller or, alternatively, a flexible squeegee, forces the paste through the screen 110 and onto the fabric wherever the holes in the screen 110 have not been covered. A suitable squeegee device is illustrated in U.S. Pat. No. 4,299,164, the content of which is incorporated herein by reference. Rotary screen printing machines employing the squeegee approach are available from Stork Brabant, B.V. of Boxmeer, The Netherlands. Rotary screen printing machines employing a roller inside the printing screen are available from the Johannes Zimmer company. The Zimmer machines use an electromagnetic device to hold the metal roller firmly against the rotary printing screen. Changing the amount of current supplied to the electromagnet changes the force with which the roller presses against the screen 110 and this controls the amount of pigment transferred to the fabric.

After being printed the fabric is routed to dryer 120 and is then stacked 124. The rotary screen process illustrated in FIG. 1 may include various other components or steps which have not been shown here for the purposes of clarity. For instance, at the exit end of the belt a glue washer may be provided to remove glue from the belt. Also, the drying process may be a multi-step process that includes the step of curing the pigments printed on the fabric in a separate curing device.

The printing pastes used for rotary screen textile printing are specific formulations that vary with the fiber being printed, the colorant system used and, to some extent, the type of printing machine used. In addition to pigments or pigments that provide color, the paste may include thickeners, binders, cross-linking agents and sequestrants. The paste may also include a disbursing agent or surfactant to assist the travel of a paste to the supply tube in the interior of the printing screen. Water-retaining agents or humectants are provided to keep the printing paste pliable. Other printing paste additives include adhesion promoters, defoamers, catalysts and hand modifiers. The functions of each of these additives are well known in the art and their selection for a particular application is within the ability of one of ordinary skill.

Suitable fabrics for rotary screen printing processes include a variety of knit fabric structures. This type of fabric may be printed in tubular form or as a flat sheet for so-called "open width" printing. The use of the tubular fabric printing is increasing as this approach is more efficient, particularly for printing T-shirts having complex designs. A typical example of this application is a hunter's camouflage T-shirt having a foliage design incorporating specific colors and patterns designed to match a particular geographic region and/or season.

Figure 2A:
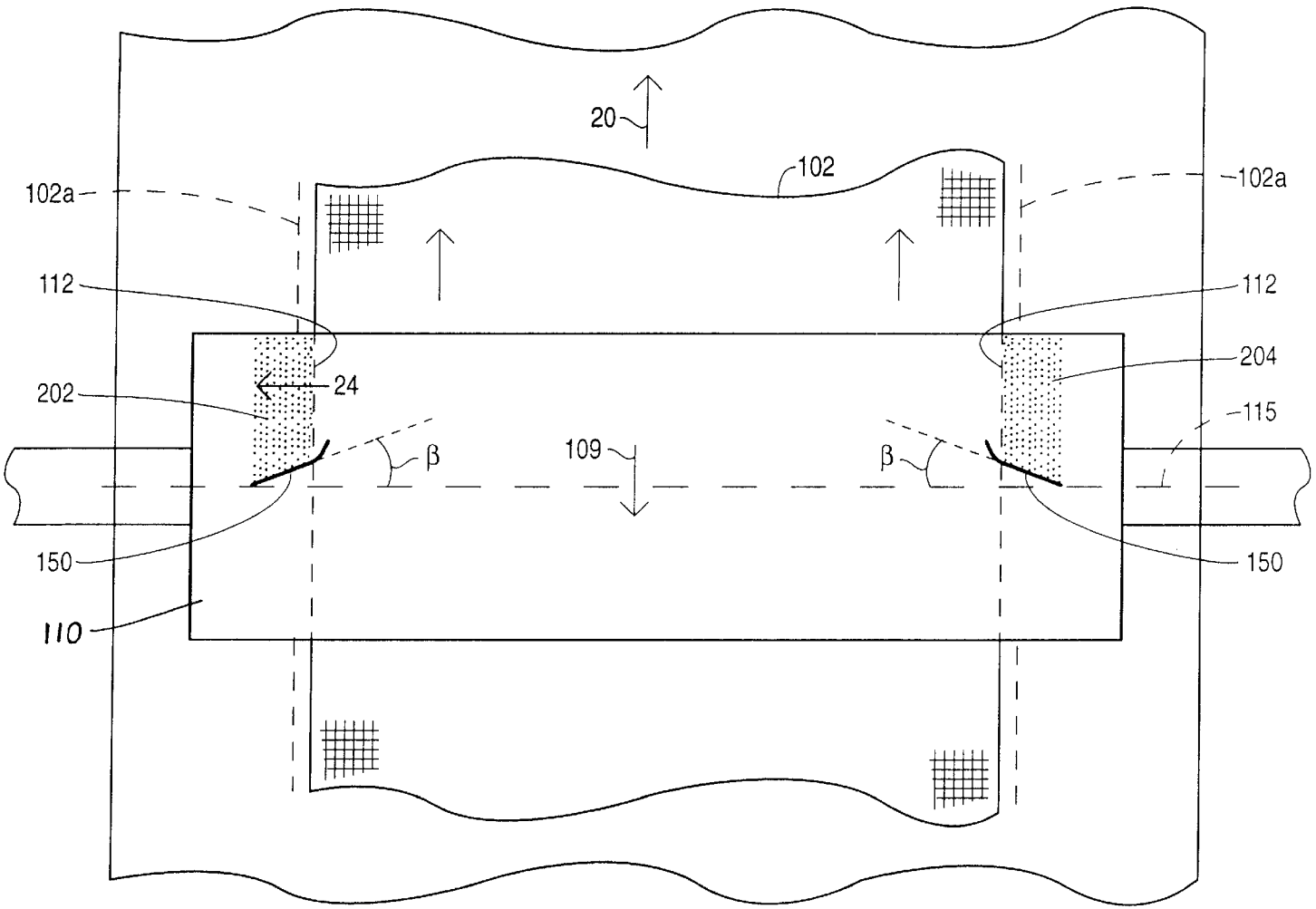
FIG. 2A is a plan view of one of a plurality of rotary screens used in the process illustrated in FIG. 1

FIG. 2A illustrates how fabric width variations cause the "dirty edge" problem discussed above. As discussed above, the fabric 102 is glued to belt 108 and is moving with belt 108 in the direction of arrow 20. The rotary screen 110 rotates about an axis of rotation 115 in the direction of arrow 109. During the printing process, excess pigment builds up on the exterior of the printing screen 110 as indicated by shaded regions 202, 204. It will be readily appreciated that these regions will be located adjacent the edge of the fabric 102 being printed. As the width of the fabric 102 varies to that shown by dotted lines 102*a*, the edges of the fabric 102 pick up the excess pigment. The amount of the width variation varies with the stability of the fabric being pigmented. Typically, the width of the knit fabric, even when carefully controlled, can vary between about 1 to 1.5 inches. Thus the overlap of the edge of the fabric 102 into each region 202, 204 may be about 0.5 inch to about 1.5 inch.

Referring now to FIG. 2A, the present invention includes providing at least one flexible wiper member 150 positioned in the excessive pigment regions 202,204. The wiper member 150 includes a straight portion and a curved portion. The flexible wiper member 150 is biased against the exterior surface of the rotary printing screen and functions to push excess pigment in the direction of arrow 24 away from the edge of the fabric 102 being printed. It is believed that the curved portion of the wiper member serves to start the pushing action in an accelerated fashion. Further the curved portion prevents pigment buildup from escaping around the end of the wiper member closest to the center of the rotary screen 110. Experiments have shown that straight wiper members will perform adequately insofar as pigment removal is concerned, but are susceptible to this problem. The pushing action may be accentuated by angling the straight portion of the flexible wiper member 150 to the axis of rotation 115 of the rotary screen 110. Preferably, the angle will be created on the "upstream" side of the axis of rotation 115 as illustrated in FIG. 2A. It will be readily appreciated that were the wiper member 150 angled to the opposite side of the axis of rotation 115, then the excessive pigment would actually be pushed towards the center of the screen 110 into the screen's active printing area. The flexible wiper member angle of inclination β may vary depending on a number of factors to include, but not limited to, the material from which the wiper member is constructed, the number of colors being applied to the fabric, the shade of color being applied the fabric, the speed of rotation of the rotary printing screen 110, the type of rotary printing screen used, the composition of the fabric being printed and various other factors that will be apparent to one of ordinary skill in the art. The wiper member angle of inclination β desirably is less than about 45 degrees. Preferably, the angle of inclination is between about 8 degrees and about 30 degrees. More preferably, the angle of inclination is between about 8 degrees and about 15 degrees. An angle of inclination of more than 45 degrees may be used. However, the length of the wiper member 150 may need to be modified to ensure that the end of the wiper member closest to the center of the rotary screen 110 remains seated thereon. If the angle of inclination is excessive, it is believed that the inside end of the wiper member 150 will not seat properly on the curved surface of the rotary screen 110, thus permitting excess pigment to escape the wiping action.

Desirably, the wiper member 150 has a length of between about 4 and about 8 inches, and is constructed of a flexible, resilient material such as an elastomeric material. Suitable examples include natural rubber, synthetic rubber and equivalents thereto. The flexible wiper member 150 may be constructed from the wipers used for automobile windshield wiping. In particular the rubber-like wiper inserts sold under the NAPA® brand are suitable for the practice of the present invention. Alternatively, the wiper member 150 may be constructed from a flat, thin, flexible metal member. This metal embodiment may be coated with an elastomeric material. However, the performance of this approach is not as desirable because the metal wiper member does not have the resiliency offered by an elastomeric material. The metal wiper member also presents the potential of damaging the screen if proper lubrication between wiper member and printing screen is not maintained.

The wiper member 150 has an outside end which is closer to the end of the rotary printing screen 110 and an inside curved end which is closer to the center of the rotary printing screen 110. Desirably, the wiper member 150 is located in the excessive pigment region 202 such that the inside end is just inside the inner edge 112 of the excessive build up regions 202,204. The wiper member inside end may overlap the active printing area of the rotary printing screen 110 by an amount between about 0.5 inch to about 2.5 inches depending on the stability and thus the width variance of the fabric being printed. Preferably, the overlap is about 0.5 inches.

Figure 2B:
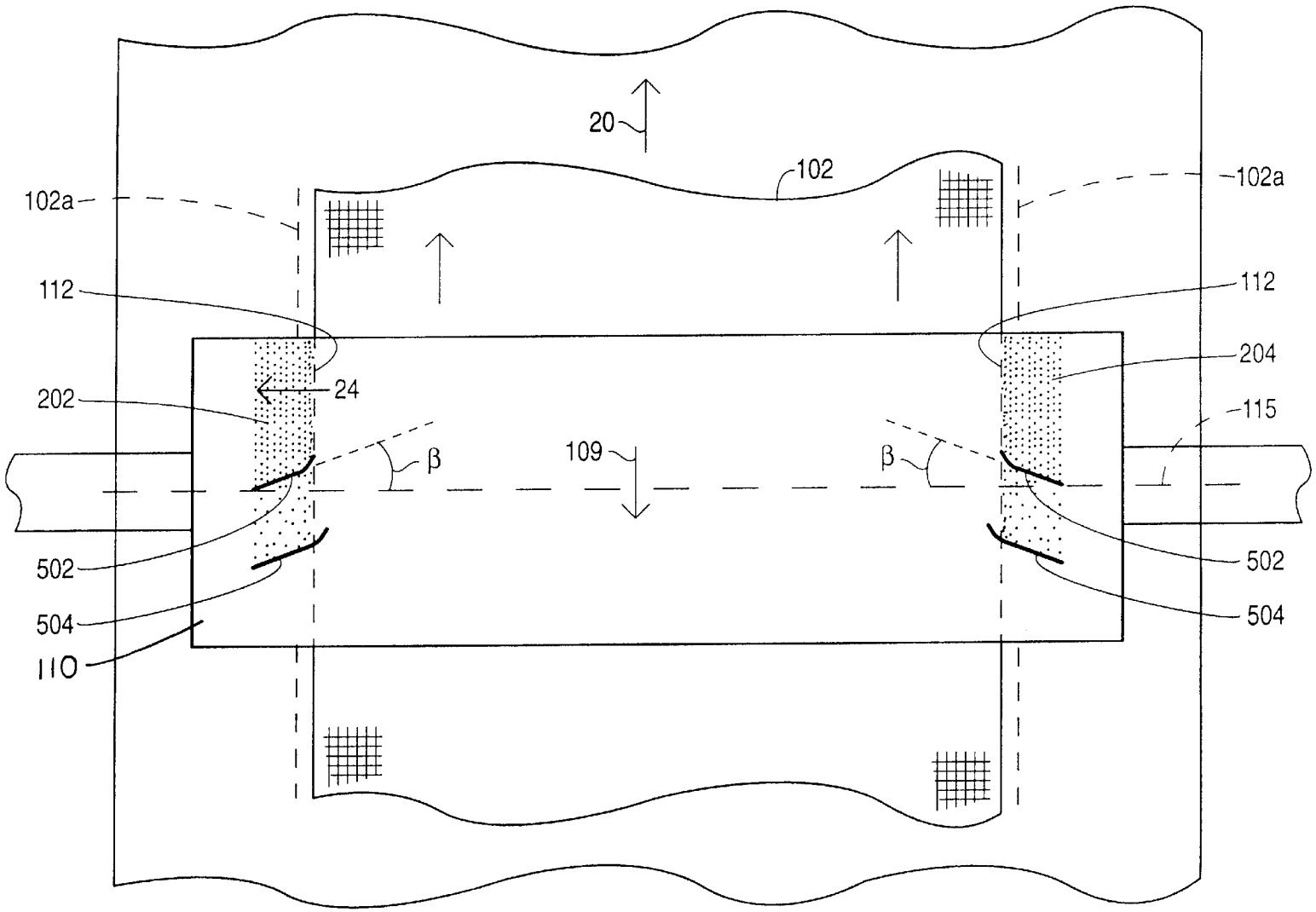
FIG. 2B is a plan view of one of a plurality of rotary screens used in the process illustrated in FIG. 1.
Figure 2C:
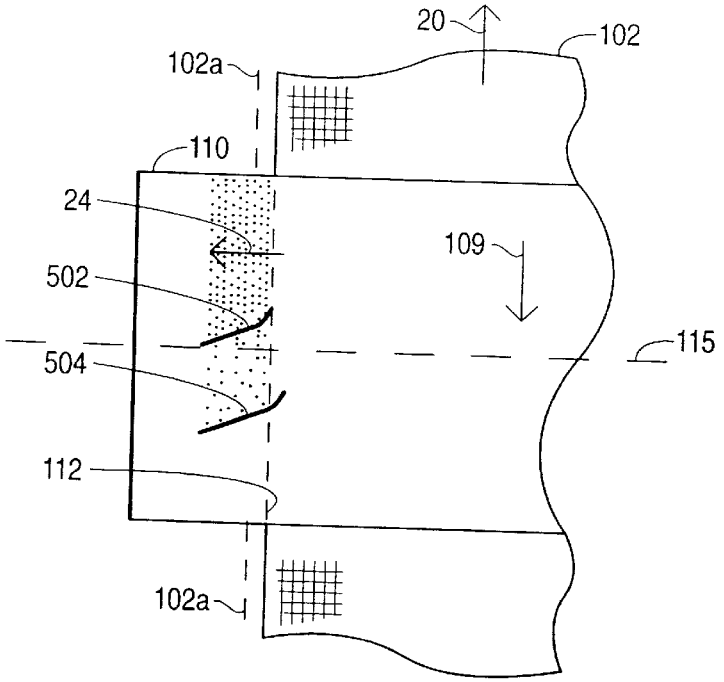
FIG. 2C is a fragmentary plan view of one end of a rotary screen used in the process illustrated in FIG. 1.
Figure 2D:
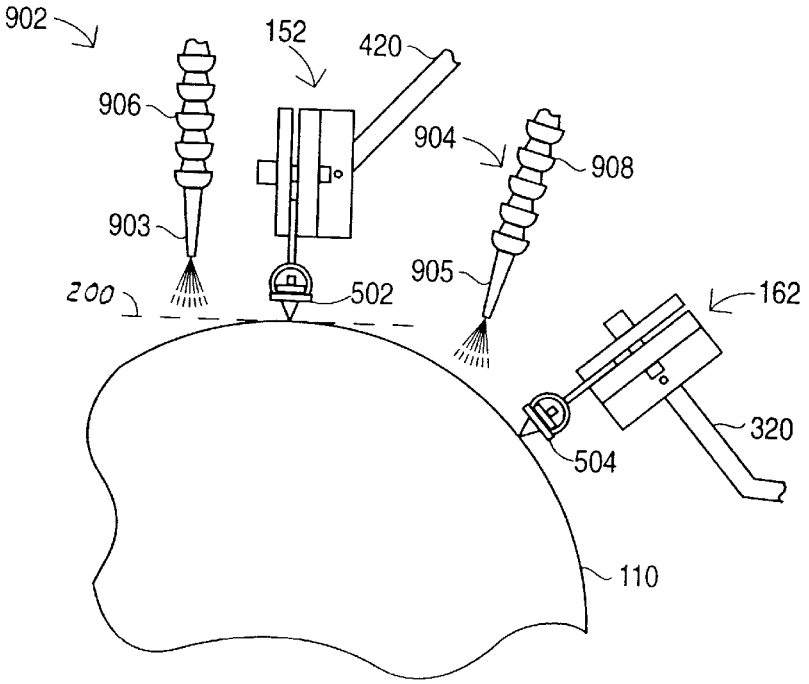
FIG. 2D is an elevational end view of one end of a rotary screen used in the process illustrated in FIG. 1.

In some circumstances, it may be desirable to provide more than one wiper member in the excessive build up regions 202,204. Accordingly, as illustrated in FIGS. 2B–2D, two wiper members 502,504 are provided in the regions of excessive pigment buildup 202,204. An preliminary wiper member 502 is positioned atop the cylinder in approximately a "12 o'clock" position. A second primary wiper 504 is provided "downstream" of the preliminary wiper member 502 at approximately a "2 o'clock" position on the rotary screen 110 such that its inside end overlaps the inner edge 112 desirably by about 0.5 inches. The inside end of the preliminary wiper member 502 is positioned just outside the inner edge 112. Because of variations in fabric width, the overlap may vary between 0.5 inches and about 2.5 inches.

It has been observed that preliminary wiper member 502, located "upstream" of the primary wiper 504, moves the majority of the excessive pigment buildup in the direction of arrow 24 and that the primary wiper 504 moves the remaining buildup. It will be appreciated that the primary wiper 504 is positioned and functions similarly to the single wiper 150. The need for the two wiper arrangement is dictated by, among other things, the color being applied to the fabric 102, the number of different colors being applied and the amount of the fabric surface being covered. Generally, more cleaning is required if darker colors are used, and as the amount of the fabric surface area being covered increases. Another factor to be considered in this regard is the nature of the fabric being printed. It may be desirable to provide two wiper members for fabrics that tend to generate greater amounts of lint. In these situations, wiper member 502 also serves as a lint remover. It should be understood that, when two wiper members are used, the wiper members may be provided in differing lengths.

Additional wiper members may be used depending on the variety of factors discussed herein. For example, it is believed that for certain printing situations, up to 8 wipers, four on each end of the rotary screen 110, will be desirable.

Figure 5:
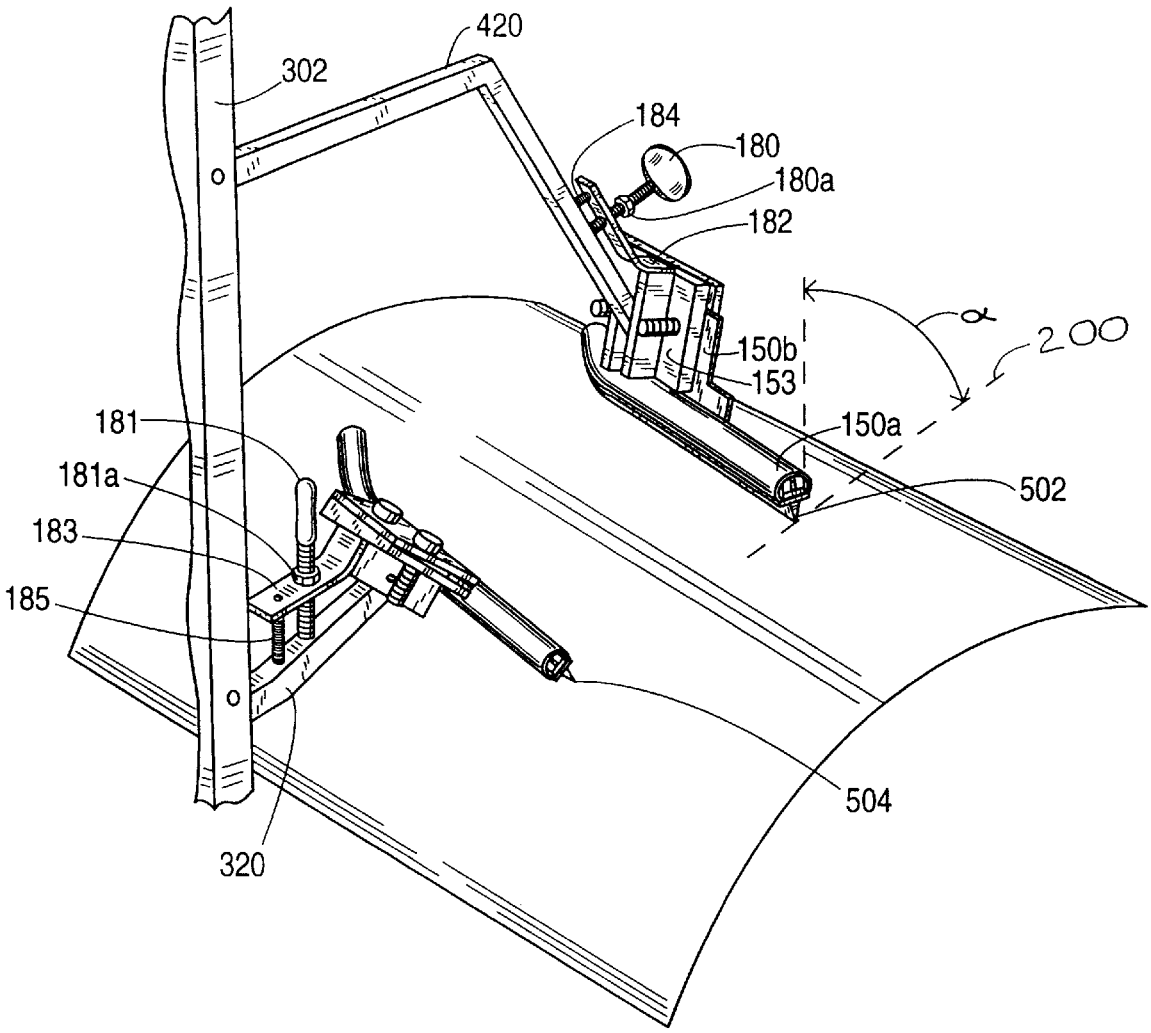
FIG. 5 is a rear perspective view of the mounting bracket used to hold the wiper member.

In either the single wiper or multiple wiper embodiments, each of the wiper members is held in a predetermined orientation the rotary screen exterior surface by mounting brackets 152,162 respectively. The term "predetermined orientation" refers to a preferred angle to the curved surface of the rotary screen. Referring to FIGS. 2D and 5, the angle α to the curved surface can be described with reference to a tangent line 200 taken at the point that wiper member 150 contacts the curved surface of the rotary screen 110. Desirably each wiper member 502,504 is maintained substantially perpendicular to the tangent line 180. This orientation is referred to as "normal" to the curved surface. It has been found that this orientation along with the angle of inclination described above optimizes movement of the excess pigment buildup away from the fabric being printed. Some minor variance of a few degrees of inclination is permissible on either side of perpendicular. However, it has been found that if the wiper members 502,504 are inclined excessively away from the direction of rotation 109, that the excessive pigment will not be moved in the direction of arrow 24. Rather, the buildup collects along and travels over the top of wiper members 502,504. Conversely, if the wiper members 502, 504 are inclined excessively towards the direction of rotation 109, then the wiper members lose their effectiveness and the excess pigment passes underneath the wiper members. The "normal" orientation is determined when the wiper members 502, 504 are first applied to the rotary screen 110 before the screen begins its rotation. During actual pigment removal operation, the flexible wiper members 502,504 may bend and appear to have a different orientation. Nevertheless, they are considered to have a "normal" orientation.

Figure 4:
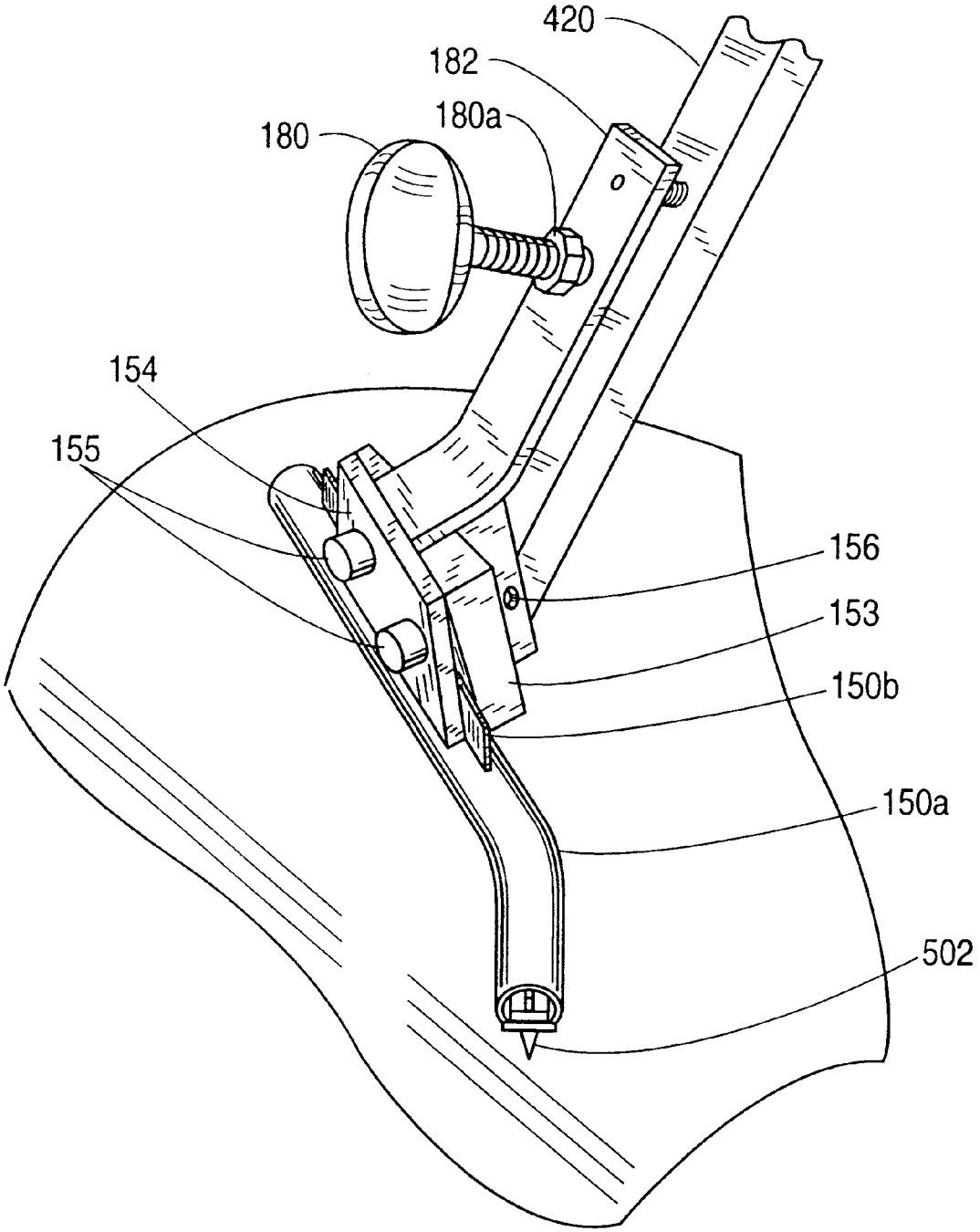
FIG. 4 is a front perspective view of the mounting bracket used to hold the wiper member.

Referring now to FIGS. 4 and 5 the details of wiper member mounting will be described. It should be understood the approach for mounting and positioning will be similar for both the single wiper member and multiple wiper member embodiments. The mounting bracket 152 includes angled mounting block 153 which is secured to wiper arm 420. A plate 154 is secured to the angled mounting block 153 with fasteners 155. The plate 154 acts as a clamp to hold the wiper member 150 in place. Wiper member is supported by a carrier 150*a* which includes an upwardly extending tab 150*b*. It will be readily appreciated that the tab 150*b* is held in place against the angled mounting block 153 be the clamping action of plate 154. The tab 150*b* may have an elongated shape as best seen in FIG. 5 so that the position of the wiper member 150 may be adjusted relative to the location of the excessive pigment buildup regions 202, 204. The angled mounting block 153 is secured to the wiper arm 420 (or 320) in such fashion that, when the wiper arm 420 and the wiper member 150 are biased against the curved surface of the rotary screw screen 110, the wiper member 150 is held at the proper angle of inclination as illustrated in FIG. 2A.

Turning now to FIG. 5 which illustrates a multiple wiper member arrangement, in a preferred embodiment, mounting block 153 is illustrated as pivotally attached to wiper arm 420 at pin 156. The pivoting action is controlled by lever arm 182 through which a thumbscrew 180 is threadedly engaged so as to contact wiper arm 420. The position of thumbscrew is maintained by lock nut 180*a*. It will be readily apparent that adjustment of the thumbscrew 180 maintains the wiper member 502 in the "normal" orientation described above. As rotary screen 110 rotates in the direction of arrow 109, the wiper member may be pushed in the direction of rotation given its ability to pivot. This tendency is controlled by the action of spring 184 which biases thumbscrew 180 against the wiper arm 420. A similar arrangement of thumbscrew 181, lock nut 181*a*, lever arm 183, and spring 185 is provided for wiper member 504. In an alternative embodiment, spring 184 may be a longer continuous spring that is wrapped around the wiper arms 320, 420 and the lever arms 182, 183.

Figure 3:
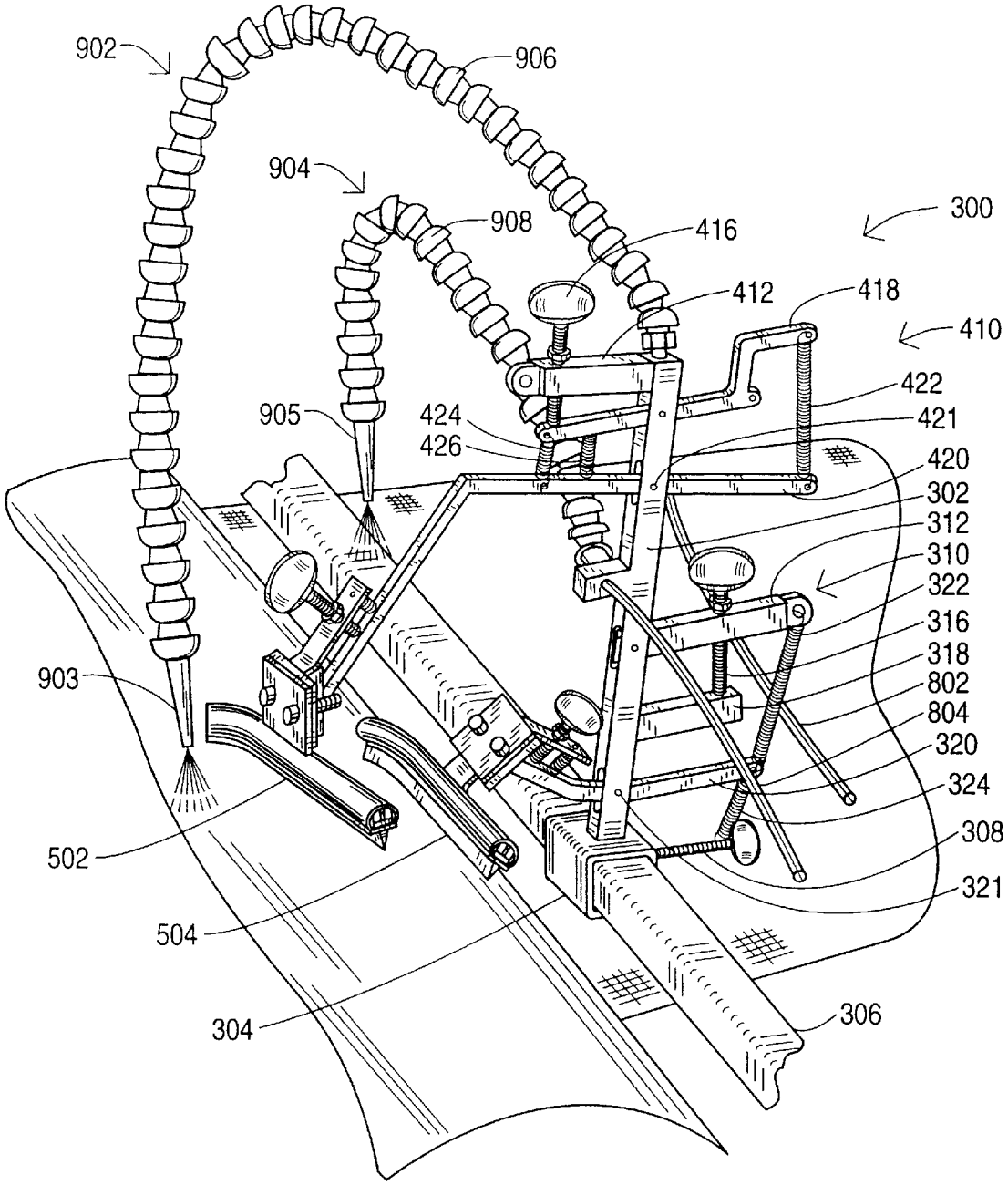
FIG. 3 is an isometric view of the tensioning system of the present invention.

In a preferred embodiment as illustrated in FIG. 3, the present invention further includes a tensioning system 300 for biasing the wiper members 502,504 against the exterior surface of the rotary printing screen 110. The tensioning system 300 is mounted on rail 306 which is substantially parallel to the axis of rotation 115 of the rotary printing screen 110. The tensioning system 300 is held in place on the rail 306 by member 304 and locking screw 308.

The tensioning system includes tensioning units 310, 410 mounted on upright support member 302. Tensioning unit 410 includes an arm member 412 having a threaded opening therethrough. Arm member 412 is secured at its first end to upright member 302. A tension arm 418 is pivotally secured to the upright support member 302 at pivot point located between tension arm first end and second end. A screw 416 is threadedly engaged in the threaded opening so as to contact the tension arm 418 at its first end. A wiper arm 420 is pivotally connected to upright support member 302 between the wiper arm first end and second end at pivot point 421. Desirably, the tension arm 418 is mounted below the arm member 412 and the wiper member 420 is mounted below the tension arm 418. A first spring 422 is connected between the tension arm second end and the wiper arm second end and serves to bias the first end of the wiper arm 420 towards the rotary screen 110. A second spring 424 is mounted between the first end of the arm member 412 and the first end of the wiper arm 420. Alternatively, an additional third spring 426 may be mounted between the first end of tension arm 418 and the first end of the wiper arm 420. The spring tension of the springs 422, 424, 426 should be selected so as to bias the wiper member 150 against the exterior surface of the rotary screen 110 so as to maintain wiper member 150 in continuous contact therewith. At the same time, the biasing force should not be so great as to cause the wiper member 502 to damage the rotary screen exterior surface. It will be appreciated that, when a single wiper member 150 is used, the tensioning system will include a single tensioning unit 410.

Turning now to tensioning unit 310, it can be seen that wiper member 504 is secured to mounting bracket 162 such that the mounting bracket holds wiper member 504 in a predetermined orientation with respect to the exterior surface of the rotary printing screen 110. The tensioning unit 310 includes arm member 312 having a first end which is pivotally attached to upright support member 302 and further contains a threaded opening therethrough. A screw 316 is threadedly engaged in the threaded opening so as to contact the screw stop 318 which is mounted on the upright support member 302 below the arm member 312 so as to engage the screw 316. A wiper arm 320 is pivotally mounted on upright support member at a position below the arm member 312 at a pivot point 321 that is located between the first end and second end of the wiper arm 320. A spring 322 is mounted between the arm member second end and the wiper arm second end. The opposing first end of the wiper arm 320 is secured to the bracket 162. A second spring 324 is mounted between the second end of the wiper arm 320 and he locking screw 308.

It will be readily appreciated that spring 322 tends to bias the wiper member 504 against the exterior surface of the rotary printing screen 110 by its action on the second end of wiper arm 320 about pivot point 321. The biasing force of spring 322 is counterbalanced by the action of spring 324.

It has been found that the flexible wiper members 502, 504 may attack the surface of the rotary screen 110 without the provision of some type of lubrication between the wiper member and the surface. Accordingly, the practice of the present invention includes applying a lubricant stream to the exterior surface of the rotary printing screen adjacent to and upstream of wiper member 502 and, if used, the second wiper member 504. The lubricant should be compatible with the pigment used for the printing process. Thus, if an oil-based paste is used, then the lubricant may be some type of solvent so as to be compatible therewith. Increasingly, water based pigments are being used to address environmental concerns. It will be readily appreciated that a suitable lubricant for use with water based pigments is water, assuming that water is compatible with any additives being used for the printing operation. The water keeps the pigment buildup in a soft and pliable condition so that the excessive pigment may be moved in the direction of arrow 24 (FIG. 2) with a minimum of biasing force exerted against wiper members 502, 504. It has been found that, if an excessive amount of lubricant is applied adjacent to either of the wiper members 502,504, pigment spattering can occur. Desirably, the amount of lubricant applied to the upstream and downstream wiper members may differ as their need for lubrication differs.

This lubrication of the exterior surface of the rotary printing screen is provided by misters 902, 904. Each of these units is comprised of a rigid bendable conduit 906, 908 and nozzles 903, 905. A suitable rigid, bendable conduits is available from Cedarberg under the FLEX-LOC brand. Suitable lubrication nozzles include the Model 105-001-3344, high momentum, extended tip nozzle sold under the QUANTUM™ brand by Uniwave. The nozzles 905,903 may be positioned as needed to direct a lubricant stream to a point adjacent to and upstream of the wiper members 502, 504 by bending the conduits 906,908 as needed. Once they are adjusted to a particular position, the conduits 906,908 will hold that position until adjusted again. Desirably, nozzles 903, 905 are positioned at a distance of between about 6 and about 18 inches away from the exterior surface of the rotary printing screen 110. Other distances may be used as necessary depending on the operating parameters discussed hereinabove.

Figure 6:
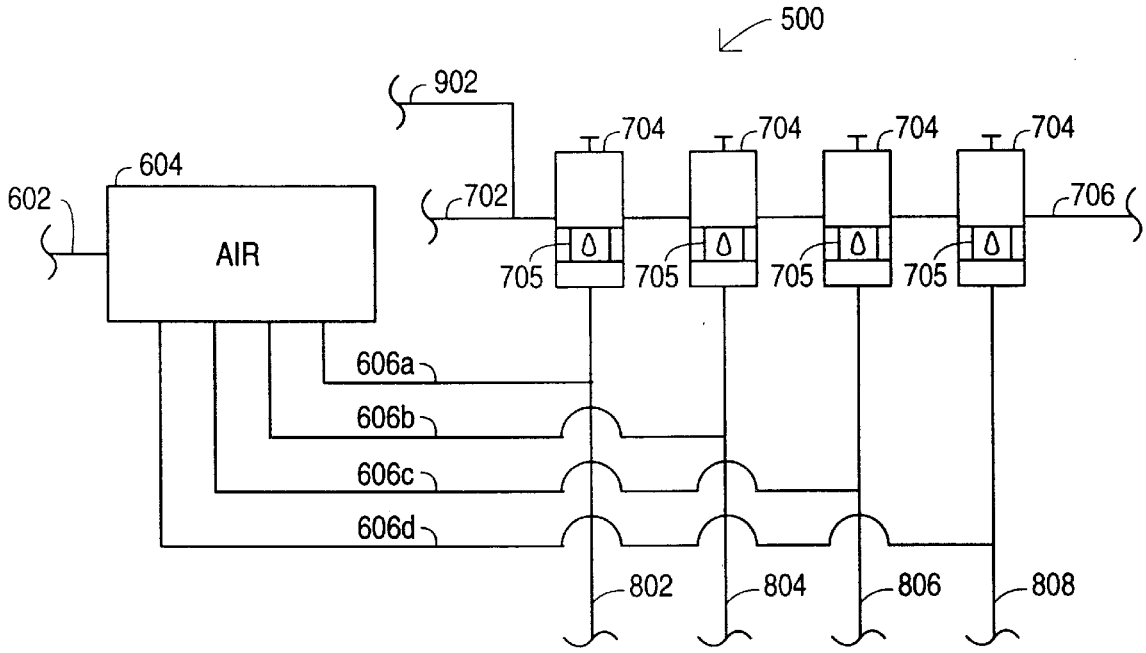
FIG. 6 is a schematic diagram of the pigment lubricant stream delivery system of the present invention.

Lubricant is supplied to nozzles 903,905 by the system illustrated schematically in FIG. 6. The lubricant supply system includes a air supply 602 and a lubricant supply 702. The lubricant supply may be additized at line 902 with any of the pigment additives discussed above. Both the incoming air and lubricant should be filtered to remove a particulate matter that could damage the rotary printing screen 110. In a preferred embodiment, an air source separate from the general purpose compressed air supply available in a typical textile printing facility is provided. Those types of air sources are characterized by a relatively high oil content that may not be suitable for the practice of the present invention. Desirably, a dedicated, oil-free air compressor is provided for the lubrication stream system. Similarly, when a water-based paste is used, it may be desirable to use a distilled water supply to reduce the likelihood that the water supply will be incompatible with the paste.

The air is received in air manifold 604 which in turn supplies individual air lines 606*a*, 606*b*, 606*c*, 606*d*. The lubricant supply line 702 is connected to at least one and, preferably, a series of lubricant metering valves 704. In the exemplary example depicted in FIG. 6, the four metering valves would be sufficient to serve one rotary printing screen cylinder having up to two wiper members at one end and two wiper members at an opposing opposite end. Lubricant line extension 706 may extend to additional sets of metering valves 704 as needed. It should be readily understood that additional meter valves may be included in each set of valves if more than four wiper members will be used on a particular cylinder.

A suitable metering valve 704 for the practice of the present invention is the Model N401 available from Lube Devices, Inc. This valve is adapted for controlled visible fluid metering and includes a sight glass 705 that facilitates a drip flow through the valve. Each of the metering valves 704 discharges to respective air supply lines 606*a*-606*d* to form lubricant delivery lines 802, 804, 806, 808, which are in fluid communication with respective conduits 906, 903.

The metering valves 704 control the flow of lubricant through nozzles 903, 905. It has been found that the volume of lubricant required to be applied adjacent to each of the wiper members 502, 504 can vary. For example, more lubricant may be required for wiper member 502 as it may move a substantial amount of the excessive pigment buildup. The resulting smaller amount of excessive pigment buildup left for removal by wiper member 504 typically requires a lower volume lubricant stream for effective excessive pigment removal.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What we claim is:

1. An apparatus for preventing excessive pigment buildup on at least one prescribed portion of the exterior surface of a rotary printing screen in a region adjacent the edge of fabric being printed comprising:

a. a flexible wiper member including means to bias the flexible wiper member against said at least one portion of the exterior surface of the rotary printing screen and positioned in the excessive pigment region;

b. a mounting bracket for holding said wiper member in a predetermined orientation with respect to the exterior surface of the rotary printing screens;

c. a lubricant stream delivery system comprising:

i. at least one lubricant delivery line;

ii. at least one bendable conduit in fluid communication with said lubricant delivery line;

iii. a nozzle mounted on said bendable conduit wherein said nozzle is adapted to apply a lubricant stream to the exterior surface of the rotary printing screen; and d. wherein the excess pigment is removed to clean the portion of the screen exterior surface after the printing of said fabric.

2. An apparatus according to claim 1 wherein said predetermined orientation is substantially normal to the rotary screen.

3. An apparatus according to claim 1 further comprising a tensioning system attached to said mounting bracket for spring biasing said flexible wiper member against the exterior surface of the rotary printing screen.

4. An apparatus according to claim 1 wherein said lubricant stream is comprised of water.

5. An apparatus according to claim 1 wherein said lubricant stream is further comprised of at least one pigment additive.

6. An apparatus according to claim 5 wherein said at least one pigment additive is a surfactant.

7. An apparatus according to claim 1 wherein said flexible wiper member is angled to the axis of rotation of the rotary printing screen so as to push the excessive pigment buildup away from the fabric being printed.

8. An apparatus according to claim 7 wherein said flexible wiper member is angled to the axis of rotation of the rotary printing screen at an angle of less than about 45 degrees.

9. An apparatus according to claim 7 wherein said flexible wiper member is angled to the axis of rotation of the rotary printing screen at an angle between about 8 degrees and about 30 degrees.

10. An apparatus according to claim 7 wherein said flexible wiper member is angled to the axis of rotation of the rotary printing screen at an angle between about 8 degrees and about 15 degrees.

11. An apparatus according to claim 1 further comprising:

a. a preliminary flexible wiper member positioned upstream of said first flexible wiper member and in the excessive pigment region; and b. a second mounting bracket for holding said second wiper member in a predetermined orientation with respect to the exterior surface of the rotary printing screen.

12. An apparatus according to claim 11 further comprising a second system for applying lubricant to the exterior surface of the rotary printing screen adjacent to and upstream of said second flexible wiper member.

13. A apparatus according to claim 11 wherein said second flexible wiper member is angled to the axis of rotation of the rotary printing screen.

14. An apparatus according to claim 13 wherein said second flexible wiper member is angled to the axis of rotation of the rotary printing screen at an angle of less than 45 degrees.

15. An apparatus according to claim 13 wherein said second flexible wiper member is angled to the axis of rotation of the rotary printing screen at an angle of between about 10 degrees and about 30 degrees.

16. An apparatus according to claim 13 wherein said flexible wiper member is angled to the axis of rotation of the rotary printing screen at an angle between about 8 degrees and about 15 degrees.

17. An apparatus according to claim 1 further comprising a. a plurality of lubricant metering valves connected to said lubricant supply line each of said lubricant metering valves discharging to a plurality of air supply lines to form a plurality of lubricant lines;

b. a plurality of bendable conduits in fluid communication with said plurality of lubricant lines each of said conduits including a nozzle mounted thereon.

18. An apparatus for preventing excessive pigment buildup on at least one prescribed portion of the exterior surface of a rotary printing screen in a region adjacent the edge of fabric being printed comprising:

a. at least one flexible wiper member including a means to bias the flexible wiper member against said at least one portion of the exterior surface of the rotary printing screen and positioned in the excessive pigment region wherein said flexible wiper member is angled less than about 45 degrees with respect to the axis of rotation of the rotary printing screen so as to push the excessive pigment buildup away from the fabric being printed;

b. a lubricant stream delivery system comprising:

i. at least one lubricant delivery line;

ii. at least one bendable conduit in fluid communication with said lubricant delivery line;

iii. a nozzle mounted on said bendable conduit wherein said nozzle is adapted to apply a lubricant stream to the exterior surface of the rotary printing screen; and c. wherein the excess pigment is removed to clean the portion of the screen exterior surface after the printing of said fabric.

19. An apparatus for preventing excessive pigment buildup on at least one prescribed portion of on the exterior surface of a rotary printing screen in a region adjacent the edge of fabric being printed comprising:

a. a preliminary flexible wiper member including a means to bias the flexible wiper member against said at least one prescribed portion of the exterior surface of the rotary printing screen and positioned in the excessive pigment region wherein said preliminary flexible wiper member is angled less than about 45 degrees with respect to the axis of rotation of the rotary printing screen so as to push a major portion of the excessive pigment buildup away from the fabric being printed;

b. a primary flexible wiper member positioned downstream of said preliminary flexible wiper and biased against the exterior surface of the rotary printing screen wherein said primary flexible wiper is positioned in the excessive pigment region and is angled less than about 45 degrees with respect to the axis of rotation of the rotary printing screen so as to push a remaining portion of the excessive pigment buildup away from the fabric being printed;

c. a lubricant stream delivery system comprising:

i. at least one lubricant delivery line;

iv. at least one bendable conduit in fluid communication with said lubricant delivery line;

v. a nozzle mounted on said bendable conduit wherein said nozzle is adapted to apply a lubricant stream to the exterior surface of the rotary printing screen; and d. wherein the excess pigment is removed to clean the prescribed portion of the screen exterior surface after the printing of said fabric.

20. An apparatus according to claim 19 further comprising a second system for applying lubricant to the exterior surface adjacent to and upstream of said preliminary and primary flexible wiper members respectively.

21. An apparatus for preventing excessive pigment buildup on at least one prescribed portion of the exterior surface of a rotary printing screen in a region adjacent the edge of fabric being printed, comprising:

a. a preliminary flexible wiper member biased against said at least one prescribed portion of the exterior surface of the rotary printing screen and positioned in the excessive pigment region of said prescribed portion wherein said preliminary flexible wiper member is angled to the axis of rotation of the rotary printing screen at an angle of less than about 45 degrees;

b. a first mounting bracket for holding said preliminary wiper member in a predetermined orientation with respect to the exterior surface of the rotary printing screen;

c. a primary flexible wiper member positioned downstream of said preliminary flexible wiper and biased against the exterior surface of the rotary printing screen and positioned in the excessive pigment region of said prescribed portion wherein said primary wiper member is angled to the axis of rotation of the rotary printing screen at an angle of less than about 45 degrees;

d. a second mounting bracket for holding said primary wiper member in a predetermined orientation with respect to the exterior surface of the rotary printing screen;

e. a tensioning system attached to said first and second adjustable mounting brackets for biasing said preliminary and primary wiper members against the exterior surface of the rotary printing screen; and f. first and second systems for applying lubricant to the outer surface of the rotary printing screen adjacent to and upstream of said preliminary and primary wiper members respectively.

22. An apparatus according to claim 21 wherein said tensioning system includes a first tensioning unit comprising:

i. a rail positioned substantially parallel to the axis of rotation of the rotary screen;

ii. a lock screw;

iii. an upright support member slidably mounted on the rail and held in place by the lock screw;

iv. a first arm member having a first end pivotally attached to said upright support member and further having a threaded opening therethrough;

v. a screw threadedly engaged in said threaded opening;

vi. a screw stop mounted on said upright support member so as to engage said screw;

vii. a first wiper arm pivotally mounted on said upright support member at a point between a first end and a second end of said first wiper arm and wherein said first end is secured to said first mounting bracket;

viii. a first spring mounted between the second end of said first arm member and the second end of said wiper arm; and ix. a second spring mounted between the second end of said wiper arm and the lock screw.

23. An apparatus according to claim 22 wherein said tensioning system further comprising a second tensioning unit connected to said second flexible wiper, said second tensioning unit comprising:

i. a second arm member secured to said upright support member at a first end and further having a threaded opening therethrough;

ii. a tension arm pivotally secured to said upright support member at a point between a first end and a second end of said tension arm;

iii. a screw threadedly engaged in said threaded opening and contacting said tension arm first end;

iv. a second wiper arm pivotally mounted on said upright support member between a first end and a second end of said second wiper arm wherein the first end is secured to said second mounting bracket;

v. a first spring mounted between the second end of said tension arm and the second end of said second wiper arm; and vi. a second spring mounted between said threaded arm second end and said second wiper arm first end.

* * * * *